US005538149A

United States Patent [19]

Martin

[11] Patent Number: 5,538,149

[45] Date of Patent: Jul. 23, 1996

[54] CONTROL SYSTEMS FOR THE LIFTING MOMENT OF VEHICLE MOUNTED BOOMS

[75] Inventor: Jay D. Martin, St. Joseph, Mo.

[73] Assignee: Altec Industries, Inc., Birmingham, Ala.

[21] Appl. No.: 329,497

[22] Filed: Oct. 26, 1994

Related U.S. Application Data

[62] Division of Ser. No. 103,516, Aug. 9, 1993, abandoned.

[51] Int. Cl.[6] ..... B66C 13/42

[52] U.S. Cl. ..... 212/278; 212/270

[58] Field of Search ..... 212/153, 155, 212/278, 280, 276, 270; 60/420, 459

[56] References Cited

U.S. PATENT DOCUMENTS

| | | | |
|---|---|---|---|
| 2,506,107 | 5/1950 | Richardson . | |
| 2,678,741 | 5/1954 | Pilch . | |
| 2,786,580 | 3/1957 | Balogh . | |
| 3,154,199 | 10/1964 | Balogh et al. . | |
| 3,811,576 | 5/1974 | Fagen . | |
| 3,884,359 | 5/1975 | Suverkrop . | |
| 3,971,008 | 7/1976 | Nishizaki et al. . | |
| 4,063,649 | 12/1977 | Hubbard et al. . | |
| 4,078,668 | 3/1978 | Hohmann . | |
| 4,185,280 | 1/1980 | Wilhelm . | |
| 4,216,868 | 8/1980 | Geppert . | |
| 4,518,090 | 5/1985 | Thomasson . | |
| 4,532,595 | 7/1985 | Wilhelm . | |
| 4,627,013 | 12/1986 | Ichiyama et al. . | |
| 4,906,981 | 3/1990 | Nield . | |
| 4,938,023 | 7/1990 | Yoshino | 60/420 |
| 4,944,364 | 7/1990 | Blasko . | |
| 5,014,863 | 5/1991 | Vlaanderen . | |
| 5,101,629 | 4/1992 | Sugiyama et al. | 60/459 |
| 5,146,746 | 9/1992 | Nagai et al. | 91/361 |
| 5,160,055 | 11/1992 | Gray | 212/278 |
| 5,333,450 | 8/1994 | Blendinger et al. | 60/459 |

FOREIGN PATENT DOCUMENTS

| | | | |
|---|---|---|---|
| 2037444 | 7/1980 | United Kingdom | 212/155 |

*Primary Examiner*—Karen B. Merritt
*Assistant Examiner*—Thomas J. Brahan
*Attorney, Agent, or Firm*—Kokjer, Kircher, Bowman & Johnson

[57] ABSTRACT

In a vehicle mounted digger derrick or crane, the moment applied to the boom by a lift cylinder is controlled in a customized manner to more fully utilize the structural strength of the machine at different working positions of the boom. In one embodiment, the moment is controlled by controlling the moment arm through a pivot link which carries the base end of the lift cylinder and which is pivoted by an auxiliary cylinder. In another embodiment, the force component of the moment is controlled in response to changes in the boom angle or moment sensed by a linear position transducer or other sensor.

9 Claims, 4 Drawing Sheets

CONTROL SYSTEMS FOR THE LIFTING MOMENT OF VEHICLE MOUNTED BOOMS

This is a division of application Ser. No. 08/103,516, filed Aug. 9, 1993, now abandoned.

FIELD OF THE INVENTION

This invention relates generally to the field of vehicle mounted booms such as those used in cranes and digger derricks. More particularly, the invention deals with controlling the lifting moment applied to the boom throughout its useful working range in order to more effectively utilize the structural strength of the machine.

BACKGROUND OF THE INVENTION

Vehicle mounted cranes and digger derricks are commonly used for a variety of construction and load handling jobs. For example, a digger derrick is useful in setting utility poles in the ground. The auger of the digger derrick is operated to dig a hole in the ground, and the machine is then used to raise the pole and set it in the hole. Various objects can be lifted to elevated positions by raising the boom with the boom lift cylinder or the winch.

Digger derricks and cranes of this type include a pedestal which is mounted in the bed of the vehicle. A rotation bearing supports a turntable on top of the pedestal, and the boom is mounted on the turntable so that it can be pivoted up and down about a horizontal boom pin. A hydraulic lift cylinder is connected between the turntable and boom to raise and lower the boom. Typically, the boom is a multiple stage unit having two or more sections that extend and retract telescopically. In the case of a digger-derrick, the boom may be provided with a variety of equipment, including a hydraulically driven auger for digging operations, a pole guide for use while raising and setting utility poles, a winch and sheave for raising and lowering loads, a jib for material handling operations, a platform for allowing personnel to work at elevated positions near the boom tip, and various other accessories. The vehicle is normally equipped with outriggers which provide stability and resist tipping of the vehicle when the boom is extended to the side and subjected to heavy loading.

In the design of equipment of this type, the lifting moment applied to the boom by the hydraulic lift cylinder is an important parameter. The lifting moment is equal to the force applied by the cylinder multiplied by the distance between a line coincident with the cylinder center line and another line which passes through the boom pivot pin and is parallel to the cylinder center line. For a conventional lift cylinder, the force component is equal to the area of the piston times the available hydraulic pressure (adjusted by friction losses, back pressures and the like). A pressure control device of some kind normally sets the maximum allowable hydraulic pressure, and the area of the piston is constant. Therefore, the maximum force component of the lifting moment is fixed. The distance component of the lifting moment (moment arm) in a conventional machine depends upon the locations of the cylinder attachment points to the turntable and boom relative to one another and to the boom pivot pin. Because all three locations are fixed, the distance component of the lifting moment is fixed at any given boom angle, although it varies as the boom angle changes. These factors are explained in more detail in SAE Technical Paper No. 830194 entitled "Standardization of Digger Derrick Capacity Ratings" by Frank D. Freudenthal (1983).

Because the maximum force component of the lifting moment is constant, the maximum lifting moment occurs at a boom angle where the distance component of the moment is maximum. As the boom is raised or lowered from this position, the moment decreases because the distance component of the lifting moment decreases. The maximum lifting moment is one of the principal factors that controls the structural design of the machine because the strength of all structural components (such as the chassis frame, the boom assembly and the turntable), as well as the outrigger design and the size and rating of the main rotation bearing, must be sufficient to withstand the maximum lifting moment. Consequently, even though the maximum lifting moment is encountered at only one position of the boom, it dictates the structural requirements that must be met. The result is that the machine structure is not fully utilized during the vast majority of its operating conditions when the boom is oriented at a position other than the maximum moment position.

SUMMARY OF THE INVENTION

The present invention is directed to an improved boom lifting arrangement for a crane or digger derrick which enhances the utilization of the structural capabilities of the machine at all normal working positions of the boom. This is accomplished by controlling the lifting moment applied by the boom lift cylinder in a manner to maintain it at a more constant level than is the case with conventional machines. As a result, the lifting moment is at or close to the maximum moment at virtually all practical working positions of the boom, and the structural strength of the machine (designed for the maximum moment) is more fully utilized at virtually all working positions of the boom. For practical reasons, it is contemplated that the lifting moment may be controlled to remain at a substantially constant level only at boom angles less than a predetermined angle such as 60 degrees from horizontal. At boom angles above this position, the control of the moment is not as important as at lower boom angles. Thus, at boom angles above 60°, it may be advantageous to maintain the lifting capacity constant rather than the lifting moment.

The present invention contemplates alternative approaches to the control of the lifting moment. Because the moment is calculated as a distance times a force, the moment can be controlled by selectively varying either the distance or the force as the boom angle changes. In accordance with one embodiment of the invention, the location of one end of the boom lift cylinder is varied relative to the boom pin and the other cylinder end as the boom is raised and lowered. Although either the base end or the rod end of the cylinder can be attached to a moving mounting point, it has been found convenient to connect the base end of the cylinder near one end of a pivot link having its other end coincident with the boom pin. The base end of the cylinder can then move in an arc about the boom pin. An auxiliary cylinder connected with the link operates to adjust the location of the cylinder base as the boom is pivoted up and down by the lift cylinder. By connecting the lift cylinder and the auxiliary cylinder in the same hydraulic system, the two cylinders can be extended and retracted in tandem such that a near constant lifting moment is achieved with a simple control system. It is also possible to vary one of the cylinder attachment points by other means such as a track or other guide arrangement.

In accordance with an alternative embodiment of the invention, the force component of the lifting moment is selectively varied as the boom angle changes, preferably by controlling the hydraulic pressure applied to the lift cylinder. A linear position transducer or another device that is sensitive to the boom angle (or to the cylinder geometry or to the moment) provides an input signal to a microprocessor (or a discrete electronic circuit). The microprocessor in turn controls a pressure regulator element in a manner to change the hydraulic pressure that is applied to the lift cylinder as the boom angle changes. Through suitable programming, the moment can be maintained at a precisely constant value at all or nearly all boom angles, or it can be customized in some other way to produce lifting characteristics that are determined to be desirable under the contemplated operating conditions of the machine.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figures 1, 2:
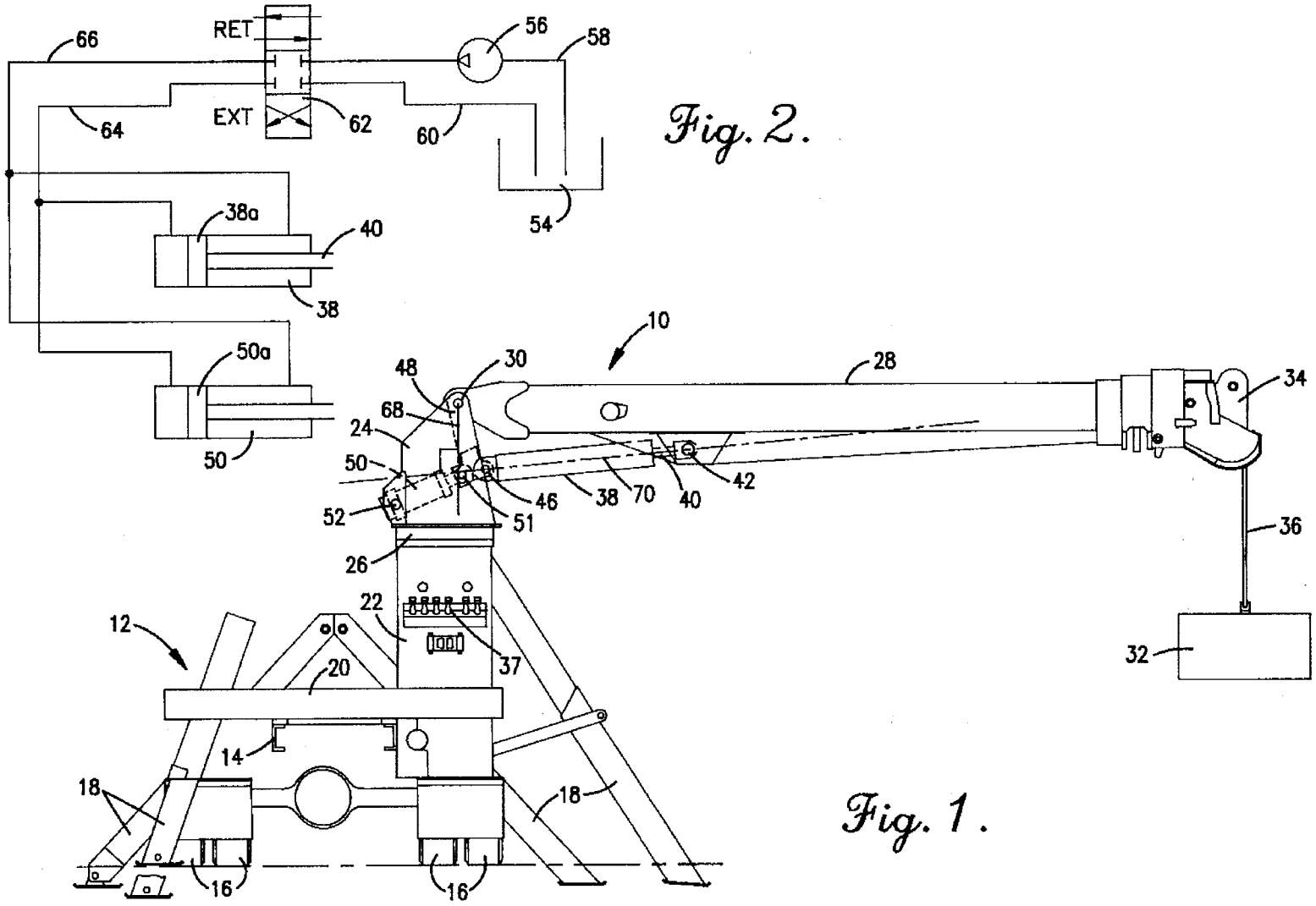
FIG. 1 is a rear elevational view of a vehicle mounted digger derrick that is equipped with a lifting moment control system constructed according to one embodiment of the present invention.
FIG. 2 is a schematic diagram of a hydraulic circuit that can be used with the moment control system of FIG. 1.

Referring now to the drawings in more detail and initially to FIG. 1, numeral 10 generally designates a vehicle mounted digger derrick of the type to which the present invention pertains. The digger derrick 10 has for the most part a conventional construction and is depicted diagrammatically for simplicity. The digger derrick 10 is mounted on a vehicle 12 having a frame 14 mounted on wheels 16. Front and/or rear outriggers 18 are used to stabilize the vehicle 12 when the digger derrick 10 is in operation.

The vehicle 12 has a generally flat bed 20 on which a pedestal 22 is mounted. A turntable 24 is mounted on top of the pedestal 22 for rotation about a generally vertical axis of main rotation. A rotation bearing 26 supports the turntable for rotational movement. The present invention is equally useful in connection with vehicle-mounted cranes and other equipment employing a boom to handle loads. The pedestal can be a center mount, rear mount, or corner mount unit.

An elongated boom 28 typically includes a number of boom sections which may be extended and retracted telescopically. Hydraulic cylinders (not shown) are used to effect telescopic extension and retraction of the boom sections in order to vary the overall length of the boom. The base end of the boom is pivotally connected with the turntable 24 by a horizontal boom pin 30 which establishes a pivot axis about which the boom 28 may be raised and lowered. Loads such as that indicated by numeral 32 can be lifted by the boom 28. The digger derrick 10 is equipped with a sheave 34 on the tip of the boom and a hydraulic winch (not shown) having a lifting cable 36 which is drawn around the sheave 34 and connected with the load 32. The boom may be raised and lowered to lift and lower the load.

Controls 37 are provided on the pedestal 22. In the case of a digger derrick, a hydraulically driven auger (not shown) is mounted on the boom 28 in a conventional manner. When not in use, the auger is stored along side the boom 28. The digger derrick 10 may be equipped with additional components and accessories such as utility pole guides, a personnel platform on the boom tip, controls on the boom tip, and a material handling jib for the tip area of the boom.

As thus far described, the digger derrick 10 is conventional. In accordance with the embodiment of the invention shown in FIG. 1, a boom lift cylinder 38 is connected in a unique manner that provides a nearly constant lifting moment as the boom 28 is raised and lowered by the cylinder 38. The cylinder 38 is a conventional hydraulic cylinder having a rod 40 which extends from and retracts into the body of the cylinder. A horizontal pin 42 pivotally connects the end of the rod 40 to the boom 28. The opposite or base end of the cylinder 38 is connected by a horizontal pivot pin 46 to one end of a rigid link 48. The opposite end of the link 48 is pivotally connected by the boom pin 30 to the turntable 24. It should be noted that the base end of the cylinder 38 (or its rod end) can be guided in other ways along a prescribed path, such as by providing a track or other guide structure.

An auxiliary hydraulic cylinder 50 has the end of its piston rod pivoted to the end of link 48 by a horizontal pin 51. The opposite or base end of cylinder 50 is connected by a horizontal pin 52 with flanges which are rigidly connected with the turntable 24.

FIG. 2 depicts a hydraulic circuit which controls the extension and retraction of the cylinders 38 and 50. A reservoir 54 contains hydraulic fluid. A pump 56 pumps fluid from the reservoir along a pressure line 58, and the fluid is returned to the reservoir along a return line 60. The lines 58 and 60 connect with a proportional directional flow valve 62 which is a commercially-available device shown in its neutral position in FIG. 2. The valve 62 may be shifted to an "extend" position in which line 58 is connected through the valve with line 64 which supplies fluid under pressure to the base ends of both cylinders 38 and 50. In the extend position of valve 62, the return line 60 is connected with line 66 which relieves fluid from the opposite ends of the cylinders 38 and 50. Consequently, when valve 62 is in the extend position, fluid pressure is applied simultaneously to the base ends of cylinders 38 and 50. The respective pistons **38*a* and 50*a*** of the cylinders are thus forced outwardly so that the connected piston rods are extended.

Conversely, the valve 62 may be shifted to its retract position. Then, lines 58 and 66 are connected with one another, and lines 60 and 64 are connected with one another. In the retract position, fluid under pressure is applied simultaneously to the outer ends of the cylinders 38 and 50, thus forcing the pistons 38*a* and 50*a* to retract. The fluid pressure in the cylinder is relieved through lines 64 and 60 when the cylinders are being retracted.

In operation of the digger derrick, the turntable 24 can be rotated by a conventional hydraulic motor (not shown) to position the boom 28 at the desired rotative position. The boom sections can be telescopically extended and retracted in order to provide the boom 28 with the desired overall length to perform whatever job is being undertaken.

The boom lift cylinder 38 is used to pivot the boom upwardly and downwardly about the boom pin 30 in order to position the tip end of the boom at the desired elevation and to raise and lower loads. The arrangement shown in FIG. 1 is advantageous because as cylinder 38 operates to pivot the boom up and down, the auxiliary cylinder 50 adjusts the position of the base end of the lift cylinder (pin 51) such that the lifting moment applied to the boom by the lift cylinder approximates a constant value throughout the normal working arc of the boom. The lifting moment at any given boom position is defined as the force applied by the lift cylinder 38 multiplied by the moment arm which is the length of the line 68 extending from the boom pin to the center line 70 of the lift cylinder, with the line 68 being perpendicular to line 70. As cylinder 38 extends to lift the boom 28 from the position of FIG. 1, cylinder 50 extends simultaneously in order to move pin 51 in a counterclockwise arc about the boom pin 30. The base end of the cylinder 38 moves along with pin 51, and the distance component of the lifting moment (or moment arm) remains at a nearly constant length as the boom is being raised. Because the force component of the moment remains constant (the fluid pressure multiplied by the cross-sectional area of the piston 38*a* adjusted for friction and other losses), maintaining the distance component of the lifting moment (moment arm) at a nearly constant value results in the lifting moment applied by cylinder 38 being nearly constant as the boom is raised and lowered. Thus, the lifting moment is close to its maximum value at all ordinary working positions of the boom and the structural strength of the vehicle frame and digger derrick structures are nearly fully utilized at all boom positions.

The principal advantage is that the structures of the machine can be designed for the maximum moment condition and are more fully utilized both at the maximum moment position of the boom and at all other positions within the useful working arc of the boom. This permits the machine to be designed with lighter frame members and structural elements than is the case with a conventional machine. The arrangement shown in FIG. 1 is also advantageous in that it permits the machine to have greater lifting capacity at most working positions of the boom.

Figure 3:
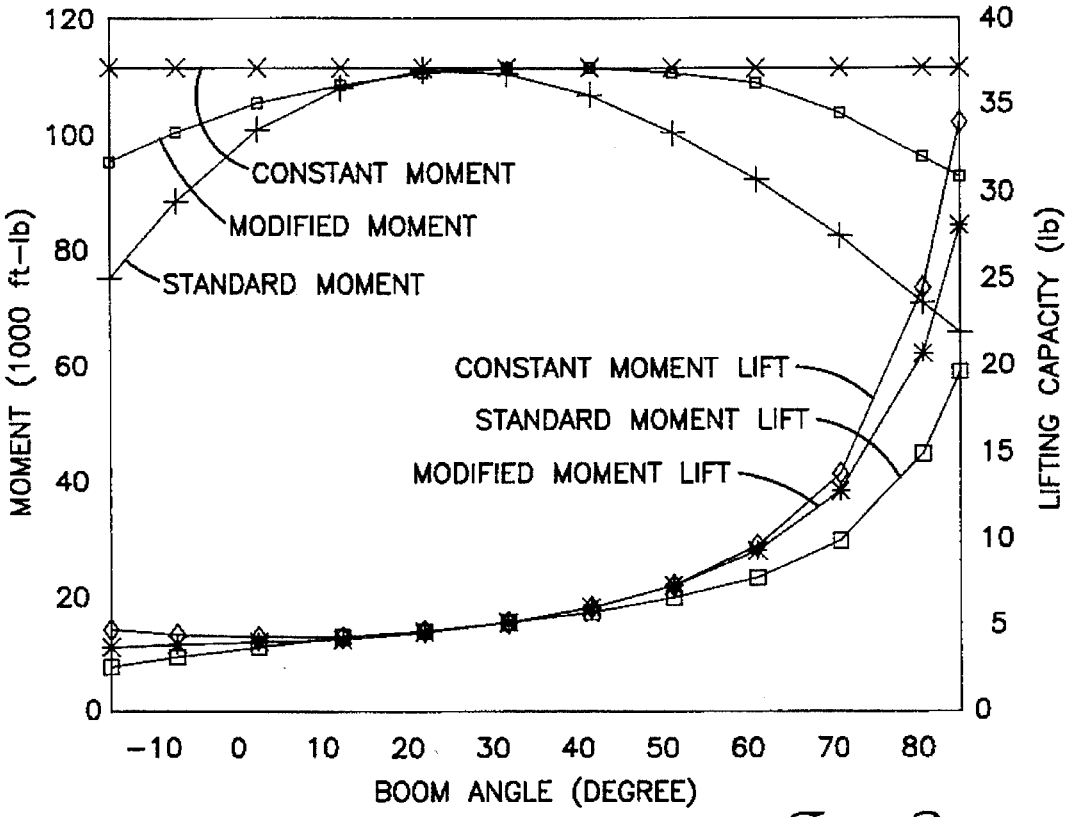
FIG. 3 is a graph showing the boom angle plotted against the moment and lifting capacity of a conventional machine and machines in which the lifting moment is controlled in accordance with two different embodiments of the present invention.

These results are depicted in graphical form in FIG. 3. The "standard moment" curve represents the moment of a representative conventional machine in which the base end of the lift cylinder 38 is located at a fixed position on the turntable 24. It is noted that there is a maximum moment at a boom angle of approximately 20° above a horizontal position of the boom and that the moment drops off fairly rapidly at boom angles less than and greater than the maximum moment boom position. The "modified moment" curve in FIG. 3 represents a plot of the moment versus boom angle for a machine equipped with the arrangement shown in FIG. 1. It is noteworthy that even though the maximum moment is the same as for the conventional machine, the modified moment drops off much more slowly above and below the maximum moment position. The moment is significantly greater at boom angles greater than about 40° and at boom angles less than 0°. The boom often works at such boom angles, so this is a significant practical advantage.

FIG. 3 also includes a plot entitled "standard moment lift" which is a plot of the lifting capacity of a conventional machine versus boom angle. The "modified moment lift" curve in FIG. 3 represents a plot of the lifting capacity versus boom angle of a machine equipped with the arrangement shown in FIG. 1. It is noted that the "modified moment lift" machine has a significantly greater lifting capacity than the "standard moment lift" machine, especially at boom angles of 50° and more which are common working positions of the boom. The boom often works at angles in the range of −20° to 0° in digging operations. As FIG. 3 evidences, the present invention, on a percentage basis, exhibits significant increases in the lifting capacity at these boom positions and is thus better able to pull the auger out of the ground (and the dirt that fills it).

From these plots, it is evident that a machine equipped with the FIG. 1 arrangement takes greater advantage of the structural strength available and has a greater lifting capacity at the vast majority of boom positions. These advantages are obtained by providing a moment that is more closely constant over the working arc of the boom than is the case with conventional machines having the base end of the lift cylinder at a fixed position on the turntable.

It may be necessary or desirable to provide a mechanical or hydraulic means for assuring that the cylinders 38 and 50 operate in unison. For example, a gear system (not shown) or other mechanism can be used to mechanically force the two cylinders to extend and retract simultaneously as intended.

Figure 4:
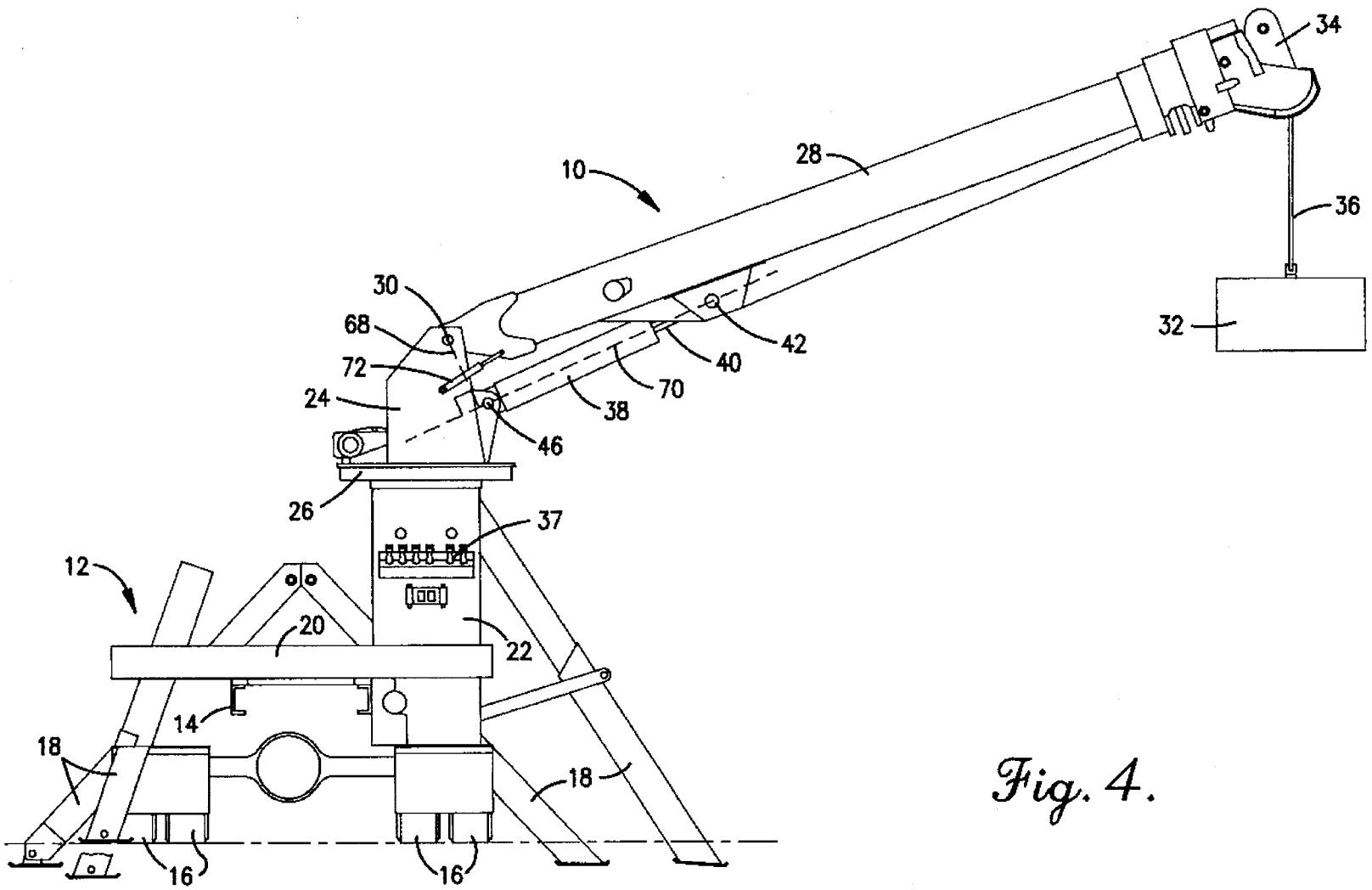
FIG. 4 is a rear elevational view of a vehicle mounted digger derrick equipped with a lifting moment control system constructed according to another embodiment of the present invention.

FIG. 4 depicts an alternative embodiment of the present invention which achieves essentially the same advantages as the embodiment of FIG. 1. In FIG. 4, the components of the digger derrick (or crane) that are similar to those depicted in FIG. 1 are identified by the same reference numerals used in FIG. 1. The principal difference between what is shown in FIG. 1 and what is shown in FIG. 4 is that the FIG. 4 arrangement eliminates the link 48 and the auxiliary cylinder 50 and has the base end of the lift cylinder 48 pinned at 46 to a fixed location on the turntable 24 as is the case on conventional machines. A conventional linear position transducer 72 (which may be a linear potentiometer) is connected between the turntable 24 and the boom 28 at locations offset from the boom pin 30. As the boom 28 is raised and lowered by cylinder 38 about the boom pin 30, the distance between the opposite ends of the transducer 72 is varied in a manner that corresponds with the boom angle and is varied in a manner that the moment arm 68 can be determined. Consequently, the transducer 72 is effective to sense the angle of the boom relative to horizontal which is conventionally referred to as the 0° position, and the transducer provides a measurement of the boom-cylinder-turret geometry at any given boom angle. Knowing this geometry orientation at any given boom angles, the moment arm can be defined. The transducer may take various alternative forms, including that of an angular position encoder or another device that measures a parameter that varies with the moment arm.

Figure 5:
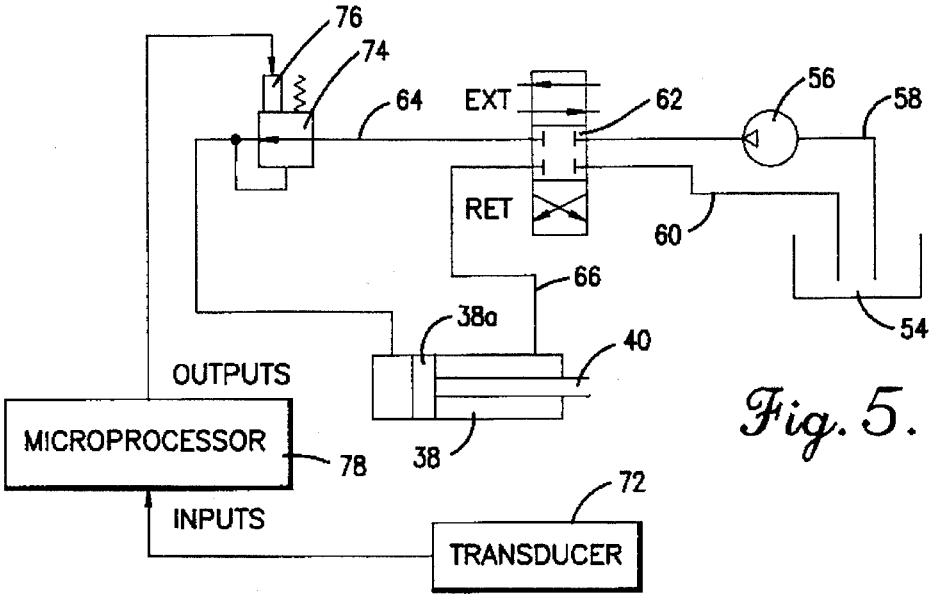
FIG. 5 is a schematic diagram of a hydraulic and electrical circuit that can be used with the control system shown in FIG. 4.

FIG. 5 depicts a control circuit which is used to control the hydraulic pressure available to the lift cylinder 38. The pressure and return lines 58 and 60 extend to the valve 62. When the valve 62 is shifted to an extend position of cylinder 38, line 58 is connected through the valve with the line 64 which extends to the base end of cylinder 38 through a proportional pressure regulator 74. The pressure regulator 74 has a control element 76 (such as a proportionally operated solenoid) which serves to adjust the pressure on the output side of the regulator, which is the pressure applied to piston 38*a* for extension of cylinder 38.

The transducer 72 provides an input signal to a programmable microprocessor 78. The microprocessor operates the control element 76 in response to the signal from the transducer 72 such that the pressure on the output side of the regulator 74 is controlled according to the angle of the boom 28 about the boom pin 30 (or according to the length of the moment arm). The microprocessor 78 can be suitably programmed to achieve virtually any desired force of cylinder 38 at each different boom angle. This allows the moment to be customized according to the desired lifting characteristics of the machine and chassis. It is contemplated that the microprocessor will normally be programmed to achieve a lifting moment applied to the boom by the lift cylinder 38 that is constant at all boom angles up to a preselected cutoff point such as 60°.

The machine of FIG. 4 obtains essentially the same advantages as the machine described in connection with FIG. 1, although it achieves its constant moment property by adjusting the force component of the moment rather than the moment arm component.

For example, FIG. 4 depicts the boom at an angular orientation of approximately 20° which is at or near the maximum moment position of a conventional machine that lacks a means for controlling the moment. As the boom is moved above or below the conventional constant moment position, the distance component of the lifting moment (moment arm) decreases. In accordance with the arrangement shown in FIGS. 4 and 5, the pressure available to the lifting cylinder 38 is correspondingly increased such that the lifting moment is maintained constant throughout the angular working arc of the boom (up to the cutoff point, above which the moment may exhibit a different characteristic).

FIG. 3 depicts a plot of the "constant moment" machine of FIG. 4. It is noted that the moment remains constant at all boom angles (even above 60°) and that the machine is therefore able to take full advantage of the structures of the machine at all times. The "constant moment lift" curve is a graph of the lifting capacity versus boom angle of the FIG. 4 machine. It is noted that the "constant moment" machine has a greater lifting capacity than a conventional "standard moment" machine and has a slightly greater lifting capacity than the "modified moment" machine which approximates but does not precisely achieve a constant moment at all boom positions.

Figures 6, 7:
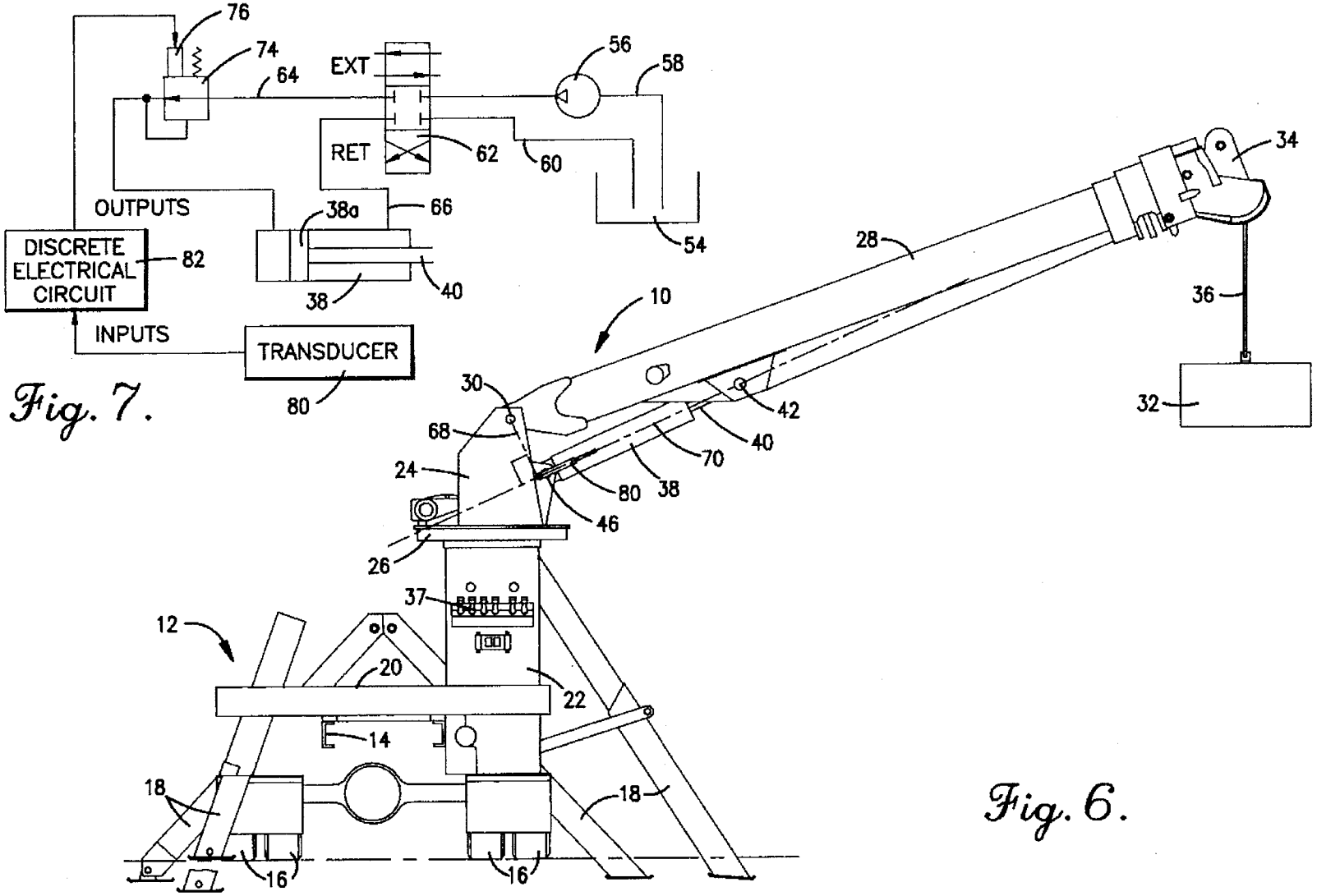
FIG. 6 is a rear elevational view of a vehicle mounted differ derrick equipped with a lifting moment control system constructed according to still another embodiment of the present invention.
FIG. 7 is a schematic diagram of a hydraulic and electric circuit that can be used with the control system shown in FIG. 6.

FIG. 6 depicts another alternative embodiment of the invention which differs from the embodiment of FIG. 4 principally in that a linear position transducer 80 (linear potentiometer) is connected to extend from the turntable 24 to the cylinder 38 in a manner such that the distance between the ends of the transducer 80 varies proportionally with the moment arm as the boom angle changes. The transducer 80 provides a voltage output signal or other electrical signal that is proportional to the transducer length and thus to the moment arm. The control circuit depicted schematically in FIG. 7 is useful with the machine shown in FIG. 6. The principal difference between the circuits of FIGS. 5 and 7 is that the microprocessor 78 of the FIG. 5 circuit is replaced in the FIG. 7 circuit by a discrete electrical circuit 82 which receives the output signal from transducer 80 (suitably amplified or otherwise modified, as desired) and responds by applying a signal to the control element 76 of the pressure regulator 74. The control element 76 may be a solenoid or other electrically controlled device. The signal from circuit 82 is such that the pressure regulator 74 adjusts the pressure in line 64 in inverse proportion to the moment arm length sensed by the transducer 80. In this way, the lifting moment is maintained constant throughout the normal angular working range of the boom. Again, the constant moment condition may be effected only at boom angles below a predetermined boom position (such as 60°), above which the moment and lifting capacity of the boom may be controlled to exhibit characteristics that are desired at higher boom angles.

In a system which makes use of a microprocessor, the transducer may be any of a variety of types that senses the boom angle or any other parameter that varies in a known way with the moment arm length. The microprocessor can be programmed to calculate what the moment arm length is from the input data it receives, and the microprocessor can provide an output signal which controls the pressure condition in the hydraulic line leading to the boom lift cylinder in a programmed manner that is desired for the particular moment arm. Consequently, a microprocessor-based system allows virtually any desired force component (zero to maximum force which is calculated by the maximum system pressure times the area of the piston) of the lifting moment to be obtained for each particular moment arm that is sensed by the transducer. The microprocessor can be reprogrammed if different moment characteristics are desired for different moment arm lengths.

A circuit that includes a discrete electrical circuit such as the circuit 82 has a transducer which is able to provide an output signal that is proportional to the moment arm length. The circuit 82 can then respond to its input signal by adjusting the pressure regulator 74 such that the pressure in line 64 is controlled in inverse proportion to the length of the moment arm. In this fashion, the circuit 82 maintains the lifting moment at a constant level throughout the ordinary working range of the boom.

A pressure regulating device such as the regulating valve 74 may be provided in line 66 in the control circuits of FIGS. 5 and 7. It would be advantageous in some situations, such as enhancing the down force capability of a digger derrick machine when digging holes with an auger.

It is thus apparent that the present invention provides different techniques for controlling the moment of the boom of a digger derrick as the boom is raised and lowered during working operations. The first embodiment of the invention (FIG. 1) controls the moment by controlling the length of the moment arm, whereas the other embodiments (FIGS. 4 and 6) control the moment by controlling the force component of the moment. Both types of arrangements make much fuller utilization of the structural capabilities of the machine than is the case with a conventional machine that does not control the moment, and both types of arrangements also provide greater lifting capacities than a conventional machine which does not control the moment.

Although the invention has been specifically described in connection with a digger derrick, it is to be understood that substantially the same advantages are obtained by making use of the invention in connection with vehicle mounted cranes and other machines having rotational booms that can be pivoted up and down by lift cylinders. It is also to be understood that the arrangement shown in FIG. 1 for adjusting the moment arm is only exemplary of the best way presently known to accomplish this, and that other arrangements are possible. For example, the rod end of the lift cylinder can be connected with the boom in a manner allowing it to move relative to the boom as the boom is raised and lowered. There are also other ways of moving the attachment points of the lift cylinder, and it is not necessary to connect the base end of the cylinder for movement in an arcuate path about the boom pin 30 as is the case with the FIG. 1 arrangement. For example, the cylinder base end or rod end can be guided along a track or other guide structure which extends in an arcuate path or some other desired path.

It is also to be understood that rather than controlling the pressure available to the cylinder, the moment can be controlled by controlling the effective area of the piston 38*a*. In either case, the result is control of the force component of the moment, and that is what the present invention is able to accomplish in a manner to obtain the advantages previously described. Sensing devices other than the types described may be used to measure the moment arm (or other parameter indicative of the moment arm), and the control function need not always be carried out by a programmable microprocessor or discrete circuit. By way of example, the lifting moment can be directly monitored by a strain gauge or other device, and the pressure applied to the lift cylinder can be adjusted to achieve a controlled moment. Direct monitoring of the moment provides an indirect measurement of the moment arm because the moment is defined as the moment arm times the force (which is dependent upon the pressure).

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. In a machine having an elongated boom mounted on a rotational turntable for up and down pivotal movement to vary the angular orientation of the boom about a boom pivot axis, the improvement comprising:

a power cylinder connected between said turntable and boom, said cylinder having a piston subjected to fluid pressure on opposite sides to extend and retract the cylinder for raising and lowering the boom about said boom pivot axis;

means for sensing a quantity indicative of the distance component of the lifting moment applied by said cylinder to the boom about the boom pivot axis; and means for varying the fluid pressure to which said piston is subjected to a plurality of different pressures in response to changes in said distance component to control the lifting moment applied to the boom by said cylinder.

2. The improvement of claim 1, wherein said varying means is effective to maintain the lifting moment at a substantially constant value as the angular orientation of the boom changes.

3. A method of controlling the moment load applied to an elongated boom mounted on a rotational turntable for pivotal movement about a boom pivot axis and raised and lowered through a working arc about the boom pivot axis by a power cylinder which is connected between the turntable and boom and which has a piston subjected to fluid pressure on opposite sides to extend and retract the cylinder, said method comprising the steps of:

sensing a quantity indicative of the distance component of the moment load applied by the cylinder to the boom about the boom pivot axis; and controlling the fluid pressure applied to the piston in accordance with said distance component in a manner to maintain the lifting moment applied to the boom by the cylinder at a substantially constant level through a substantial portion of said working arc as the boom is pivoted up and down about the boom pivot axis.

4. In a machine having an elongated boom mounted on a rotational turntable for up and down pivotal movement to vary the angular orientation of the boom about a boom pivot axis, the improvement comprising:

a power cylinder connected between said turntable and boom, said cylinder having a piston subjected to fluid pressure on opposite sides to extend and retract the cylinder for raising and lowering the boom about said boom pivot axis;

means for sensing a quantity indicative of the distance component of the lifting moment applied by said cylinder to the boom about the boom pivot axis;

means for using said quantity to determine said distance component; and means for varying the fluid pressure to which said piston is subjected to a plurality of different pressures in response to changes in said distance component to control the lifting moment applied to the boom by said cylinder.

5. A method of controlling the moment load applied to an elongated boom mounted on a rotational turntable for pivotal movement about a boom pivot axis and raised and lowered through a working arc about the boom pivot axis by a power cylinder which is connected between the turntable and boom and which has a piston subjected to fluid pressure on opposite sides to extend and retract the cylinder, said method comprising the steps of:

sensing a quantity which is indicative of the distance component of the moment load applied by the cylinder to the boom about the boom pivot axis;

determining said distance component from said quantity; and controlling the fluid pressure applied to the piston in accordance with said distance component in a manner to maintain the lifting moment applied to the boom by the cylinder at a substantially constant level through a substantial portion of said working arc as the boom is pivoted up and down about the boom pivot axis.

6. In a machine having an elongated boom mounted on a rotational turntable for up and down pivotal movement to vary the angular orientation of the boom about a boom pivot axis, the improvement comprising:

a power cylinder connected between said turntable and boom, said cylinder having a piston subjected to fluid pressure on opposite sides to extend and retract the cylinder for raising and lowering the boom about said boom pivot axis;

means for sensing the angular orientation of the boom about said boom pivot axis; and means responsive to the angular orientation of the boom for varying the fluid pressure to which said piston is subjected to a plurality of different pressures, thereby controlling the lifting moment applied to the boom by said cylinder.

7. The improvement of claim 6, wherein said varying means is effective to maintain the lifting moment at a substantially constant value as the angular orientation of the boom changes.

8. A method of controlling the moment load applied to an elongated boom mounted on a rotational turntable for pivotal movement about a boom pivot axis and raised and lowered through a working arc about the boom pivot axis by a power cylinder which is connected between the turntable and boom and which has a piston subjected to fluid pressure on opposite sides to extend and retract the cylinder, said method comprising the steps of:

sensing the angular orientation of the boom about said boom pivot axis; and controlling the fluid pressure applied to the piston in accordance with said angular orientation in a manner to maintain the lifting moment applied to the boom by the cylinder at a substantially constant level throughout a substantial portion of the working arc as the boom is pivoted up and down about the boom pivot axis.

9. In a machine having an elongated boom mounted on a rotational turntable for up and down pivotal movement to vary the angular orientation of the boom about a boom pivot axis, the improvement comprising:

a power cylinder connected between said turntable and boom, said cylinder being subjected to fluid applied force in opposite directions to extend and retract the cylinder for raising and lowering the boom about said boom pivot axis;

means for sensing a quantity indicative of the distance component of the lifting moment applied by said cylinder to the boom about the boom pivot axis; and means for varying the force to which said power cylinder is subjected to a plurality of different forces in response to changes in said quantity to control the lifting moment applied to the boom by said cylinder in a preselected way.

* * * * *